United States Patent [19]

Forsyth et al.

[11] Patent Number: 4,717,515

[45] Date of Patent: Jan. 5, 1988

[54] APPARATUS FOR DISPERSING FLUIDS IN LIQUIDS

[75] Inventors: Robert H. Forsyth, Englewood; Troy W. Fieselman, Littleton, both of Colo.

[73] Assignee: Wilfley Weber, Inc., Englewood, Colo.

[21] Appl. No.: 908,644

[22] Filed: Sep. 18, 1986

Related U.S. Application Data

[63] Continuation of Ser. No. 728,105, Apr. 29, 1985, abandoned.

[51] Int. Cl.[4] ..... B01F 3/04

[52] U.S. Cl. ..... 261/122; 210/221.2; 261/124; 366/107; 422/231

[58] Field of Search ..... 261/77, 87, 93, 122, 261/124, DIG. 7, DIG. 75; 210/221.2; 209/170; 422/231; 417/167; 366/101, 107

[56] References Cited

U.S. PATENT DOCUMENTS

| | | | |
|---|---|---|---|
| 2,081,382 | 5/1937 | Piatt | 261/122 |
| 3,256,802 | 6/1966 | Karr | 261/122 X |
| 3,545,731 | 12/1970 | McManus | 261/122 |
| 3,744,775 | 7/1973 | Greenberg | 261/DIG. 75 |
| 3,884,812 | 5/1975 | Lindquist | 261/DIG. 75 |
| 3,927,152 | 12/1975 | Kyrias | 261/122 |
| 4,117,048 | 9/1978 | Stockner et al. | 261/122 X |
| 4,193,950 | 3/1980 | Stockner et al. | 261/93 X |
| 4,521,349 | 6/1985 | Weber et al. | 261/93 |

FOREIGN PATENT DOCUMENTS

| | | | |
|---|---|---|---|
| 2826259 | 1/1979 | Fed. Rep. of Germany | 261/DIG. 75 |
| 694918 | 7/1953 | United Kingdom | 261/DIG. 75 |

*Primary Examiner*—Richard L. Chiesa
*Attorney, Agent, or Firm*—Clement and Ryan

[57] ABSTRACT

A fluid diffuser for dispersing gas bubbles or liquid droplets into a body of receiving liquid in a tank. The diffuser includes a fluid-emitting member for communication with the body of receiving liquid, which member defines a fluid plenum. A portion of at least one of the walls of the fluid-emitting member is porous and has a foraminous outer surface, to permit the passage of fluid from the plenum into the body of liquid. A slot-forming chamber has a wall that defines a narrow, elongated slot extending parallel to the foraminous outer surface of the plenum-defining wall of the fluid-emitting member, with the foraminous outer surface lying primarily outside the slot. Fluid supplied under pressure to the plenum flows out through the porous wall portion to produce small nascent fluid spheroids on the foraminous surface of that portion. Shearing liquid introduced into the slot-forming chamber under pressure exits through the narrow, elongated slot to form a stream of liquid that sweeps across and in contact with the foraminous outer surface just mentioned and shears the nascent spheroids off to form fine gas bubbles or fine liquid droplets. These are carried into the body of receiving liquid by the stream of shearing liquid as it exits from the slot and moves into the body of receiving liquid.

10 Claims, 7 Drawing Figures

APPARATUS FOR DISPERSING FLUIDS IN LIQUIDS

This application is a continuation of co-pending application Ser. No. 728,105 filed Apr. 29, 1985, now abandoned.

This invention relates to a fluid diffuser and method for dispersing fine gas bubbles or liquid droplets into a body of receiving liquid, and in particular apparatus and method utilizing at least one stream of shearing liquid that is formed by the passage of liquid under pressure through a narrow, elongated slot.

BACKGROUND OF THE INVENTION

There are several factors that affect the rate of gas dissolution in a liquid. The ideal method of introduction of fine gas bubbles into a body of receiving liquid will accomplish the following:

1. Produce sufficiently small bubbles to maximize retention time and bubble surface area for a given total volume of gas;
2. Produce bubbles as nearly uniform as possible in size;
3. Minimize turbulence and resulting coalescence of the gas bubbles;
4. Produce bubbles with the least expenditure of energy; and
5. Cause as uniform dispersion of the gas bubbles as practicable throughout the body of receiving liquid.

The usefulness of a gas diffuser is generally measured as a function of its efficiency, or in other words the amount of gas dissolved versus the energy expended. All the factors listed above have an effect on the efficiency of any apparatus and method used. These relationships are also true of liquid-in-liquid diffusion.

The present invention employs a unique and improved shearing apparatus and method that achieves a high level of efficiency. This invention can be used to advantage in any application in which a large quantity of fine gas bubbles or fine liquid droplets is to be dispersed in a body of receiving liquid, such as, for example, in (1) the oxygenation of fish hatchery raceways or of tank trucks for transporting fish, (2) the oxygenation of sewage in a sewage treatment plant, (3) the oxygenation of natural bodies of water, (4) the carbonation of soft drinks, (5) the emulsification of liquids in chemical processes, or (6) other similar applications.

DISADVANTAGES OF THE PRIOR ART

One of the oldest methods for introducing gas bubbles into a body of liquid is the method in which the gas is caused to flow through a porous structure to form bubbles that are dispersed into the liquid after they have grown large enough for their buoyancy to overcome the surface tension that holds them to the porous structure. Since the bubbles so formed are necessarily quite large in size, there are many applications for which they are unacceptably large.

A number of methods involving the use of shearing liquid have been employed to produce gas bubbles of significantly smaller size. Some of these, of which Kyrias U.S. Pat. No. 3,927,152 and Stockner et al. U.S. Pat. Nos. 4,117,048 and 4,193,950 are examples, employ a stream of shearing liquid that passes through a slot or narrow passage or other restricted space the walls of which are porous. Gas under pressure flows through the porous walls to produce small nascent bubbles on the foraminous surfaces of the walls, where they are sheared off by the stream of liquid passing through the slot or restricted space.

Kyrias points out the need to establish the proper flow regime across the minute openings in the foraminous surface through which gas is introduced into the receiving liquid, but then leads away from the present invention by confining the capillary openings utilized there to the interior of his slot or narrow passage through which a stream of shearing liquid is developed, which slot is preferably quite narrow.

Stockner et al. likewise emphasize that in their devices the capillary passages through which gas passes to be sheared off into fine bubbles are confined to the relatively narrow constricted spaces between pairs of ribs that together form a Venturi nozzle. In addition, both Stockner et al. patents deal with turbulent flow, and have nothing to do with the shearing liquid boundary layer flow that is the hallmark of applicants' method.

The device of the Kyrias patent produces quite fine gas bubbles, but fabrication problems limit the width of the foraminous surface defined by the inner walls of the slots past which the shearing liquid flows (i.e., the distance from the inlet end to the outlet opening of the narrow passage), and this fact limits the quantity of fine gas bubbles that can be produced. Furthermore, if the width of the foraminous surface or surfaces across which the shearing liquid flows within the slots or narrow passages of the Kyrias device is increased too much in an effort to increase the number of bubbles produced, another problem may arise. For if the internal walls of the slot in which the bubbles are formed confine the shearing liquid too long, not only will there be increased hydrodynamic friction but there will be increased turbulence in the shearing liquid stream and the bubbles that are formed in the slot and swept along by the shearing liquid will coalesce and form larger bubbles than are desirable.

The disadvantages just discussed are all avoided by the present invention.

SUMMARY OF THE INVENTION

The fluid diffuser of this invention includes a fluid-emitting member for submersion in a body of receiving liquid, which member includes external walls that define a fluid plenum, with a portion of at least one of the walls being porous and having a foraminous outer surface. The fluid-emitting member has a fluid inlet, and the porous wall portion referred to permits the passage of fluid that is introduced into the plenum out through the foraminous outer surface of the porous wall portion and into the body of liquid.

The fluid diffuser also includes a slot-forming chamber with a narrow, elongated slot in one wall. This slot is formed by two opposed interior walls, each of which is imperforate for substantially its entire extent. The slot extends parallel to the foraminous outer surface of the porous wall portions of the fluid plenum adjacent the rear border of the foraminous outer surface. The foraminous outer surface lies primarily, preferably entirely, outside this slot.

The slot-forming chamber has an inlet for the introduction into the chamber of shirring liquid under pressure. The shearing liquid introduced into the slot-forming chamber under pressure exits through the narrow, elongated slot in one wall of the chamber, to form a stream of liquid that sweeps across and in contact with the foraminous outer surface of the plenum-defining wall of the fluid-emitting member.

Fluid supplied under pressure to the plenum flows out through the porous wall portion to produce small nascent fluid spheroids on the foraminous surface of that portion. As the stream of shearing liquid described above sweeps across and in contact with the foraminous outer surface, it shears the nascent spheroids off the foraminous surface and forms fine gas bubbles or fine liquid droplets. These bubbles or droplets are then carried into the body of receiving liquid by the stream of shearing liquid as it exits from the narrow, elongated slot and moves into the body of receiving liquid.

The outlet end of the narrow, elongated slot is preferably located immediately adjacent the rear or upstream border of the foraminous outer surface of the above mentioned plenum-defining wall of the fluid-emitting member. In the preferred embodiment, the narrow, elongated slot has opposed exterior walls the surfaces of which are planar and substantially parallel to each other throughout the extent of the slot. Likewise, it is preferred that the foraminous outer surface of the plenum-defining wall of the fluid-emitting member by a substantially planar surface, with the surface of one of the internal opposed walls of the narrow, elongated slot lying in substantially the same plane as the plane of the foraminous outer surface.

BRIEF DESCRIPTION OF THE DRAWING

The invention will now be described in reference to the accompanying drawing, in which.

DETAILED DESCRIPTION OF THE INVENTION

Figure 5:
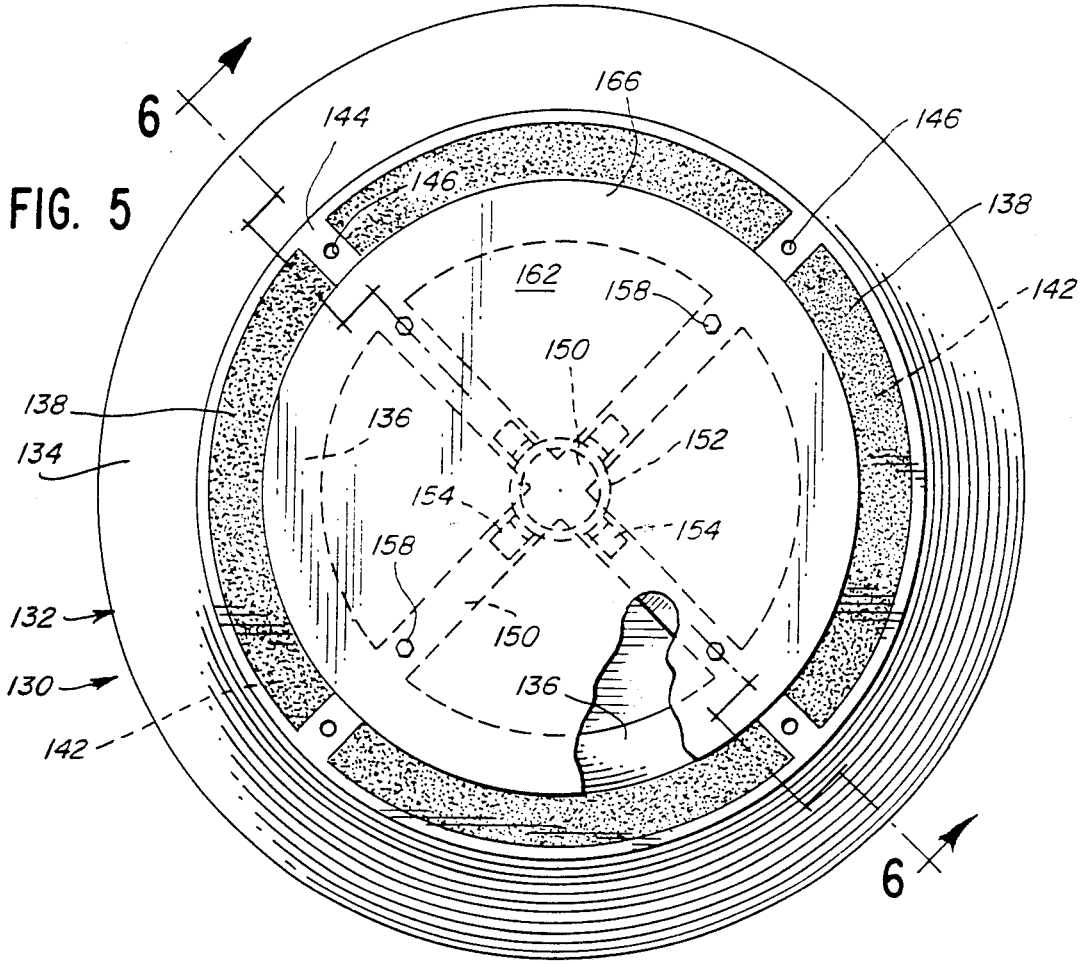
FIG. 5 (on the same sheet with FIG. 1) is a plan view of a third embodiment of a fluid diffuser of this invention.

Four embodiments of the fluid diffuser of this invention will now be described with detailed reference to the various Figures of the drawing.

First Embodiment Of Apparatus

Figure 1:
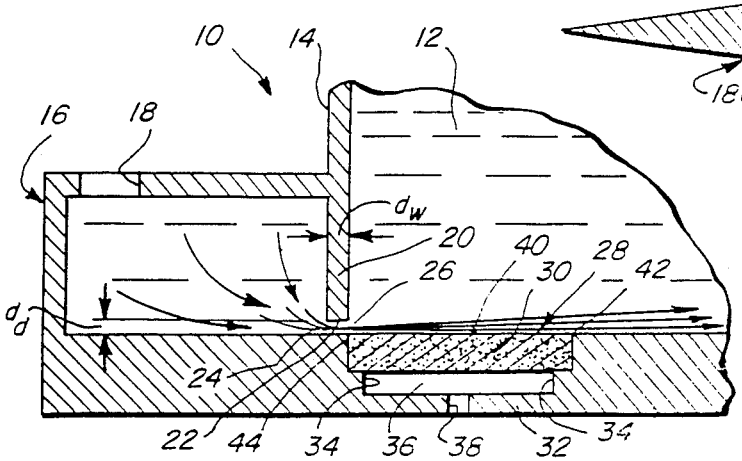
FIG. 1 is a cross-sectional view of one embodiment of a fluid diffuser in accordance with this invention for dispersing fine gas bubbles or liquid droplets into a body of receiving liquid in a tank.

FIG. 1 is a cross-sectional view of fluid diffuser 10 for dispersing gas bubbles or liquid droplets into a body of receiving liquid 12 contained in tank 14.

Shearing liquid is supplied under pressure to diffuser 10 from a suitable source (not shown), and is introduced into slot-forming chamber 16 through inlet 18. Slot-forming chamber 16 has a wall 20 that defines narrow, elongated slot 22. Slot 22 has an inlet end 24 in communication with chamber 16 and an outlet end or opening 26 in communication with receiving liquid 12 in tank 14. As seen from FIG. 1, slot 22 provides a narrow passage defined by its opposed walls that extends from inlet end 24 to outlet opening 26. This passage directs the flow of a stream of shearing liquid therethrough, and across and in contact with the foraminous outer surface 40 of fluid-emitting member 28.

In the embodiment shown in FIG. 1, fluid-emitting member 28 is in communication with body of receiving liquid 12. Member 28 includes external horizontal walls 30 and 32 and vertical external walls 34 that define fluid plenum 36. The walls also define fluid inlet 38 for supplying fluid under pressure to the interior of plenum 36. As already indicated above, the fluid for dispersal into receiving liquid 12 may be either a gas or liquid.

External wall 30 of fluid-emitting member 28 is porous, and has a foraminous outer surface 40. Porous wall 30 permits the passage of fluid from plenum 36 through foraminous surface 40 and into body of receiving liquid 12. Foraminous surface 40 has a front border 42 and a rear border 44.

Narrow, elongated slot 22 extends parallel to foraminous outer surface 40 of wall 30. The slot is located adjacent rear or upstream border 44 of foraminous surface 40, with surface 40 lying primarily outside slot 22. Rear or upstream border 44 may be located slightly within or spaced slightly outside slot 22. As a result, the opposed interior walls of elongated slot 22 which are referred to below are imperforate for substantially all their extent. In the preferred embodiment shown in FIG. 1, outlet 26 of slot 22 is located immediately adjacent rear or upstream border 44 of surface 40, and surface 40 lies entirely outside and thus the opposed interior walls of slot 22 are imperforate throughout their entire extent.

Slot 22 has opposed interior walls which, as indicated in FIG. 1, are planar and substantially parallel to each other throughout the extent of the slot. Each of these opposed interior walls is imperforate throughout its entire extent. Foraminous surface 40 of wall 30 is a substantially planar surface and lies in substantially the same plane as the lower one of the internal opposed walls of slot 22.

As will be seen, with this construction, the downstream extension of each straight line that lies in a predetermined one of the two opposed interior walls (i.e., the lower wall in FIG. 1) forming slot 22 just upstream of outlet opening 26, and that is oriented in the direction of flow of the stream of shearing liquid through slot 22, lies in foraminous surface 40 in at least the portion of that surface adjacent the outlet opening. In the embodiment of FIG. 1, each of the straight lines described lies in foraminous surface 40 throughout its entire area.

The distance slot 22 extends in the direction that shearing liquid moves through the slot, which is equal to the thickness of wall 20 of slot-forming chamber 16, is defined in this specification to be the width $d_w$ of the slot. (See FIG. 1.) Slot-defining wall 20 is preferably relatively thin, with a sharp edge along outer end or opening 26 of the slot. As will be recognized by those skilled in the art, to avoid turbulence in the shearing liquid either as it enters or as it exits from slot 22, wall 20 should be neither too thin nor too thick.

The perpendicular distance between the opposed interior walls that form slot 22 is defined in this specification as the depth $d_d$ of the slot (FIG. 1). Satisfactory results are obtained if this dimension is approximately 0.060" when the shearing liquid is water. A slot depth of approximately 0.030" gives improved results, and a slot that is approximately 0.020" in depth gives still further improved results.

The third dimension of slot 22, the distance it extends in its longest direction, is determined by the lengthwise dimension of the porous medium located adjacent the slot.

As a result of the construction described, fluid (whether gas or liquid) supplied under pressure to planum 36 through inlet 38 will flow out through porous wall 30 to produce small nascent fluid spheroids on foraminous surface 40. Shearing liquid introduced into slot-forming chamber 16 under pressure will exit through outlet opening 26 of narrow, elongated slot 22 to form a stream of liquid that then sweeps across and in contact with surface 40 to shear the nascent spheroids off that surface and form fine gas bubbles or fine liquid droplets, as the case may be. These bubbles or droplets are carried into body of receiving liquid 12 in tank 14 by the stream of shearing liquid as it exits from slot 22 and moves into the receiving liquid.

Since the foraminous surface of the fluid-emitting member lies primarily outside the slot from which the stream of shearing liquid exits, it is only after that stream leaves its forming slot that it sweeps across the majority of the area of the foraminous surface. In the preferred embodiment of this invention shown in FIG. 1, foraminous surface 40 lies entirely downstream from slot 22, and thus in this embodiment the stream of shearing liquid sweeps across the entire area of surface 40 after it leaves outlet end or opening 26 of slot 22.

Second Embodiment Of Apparatus

Figure 2:
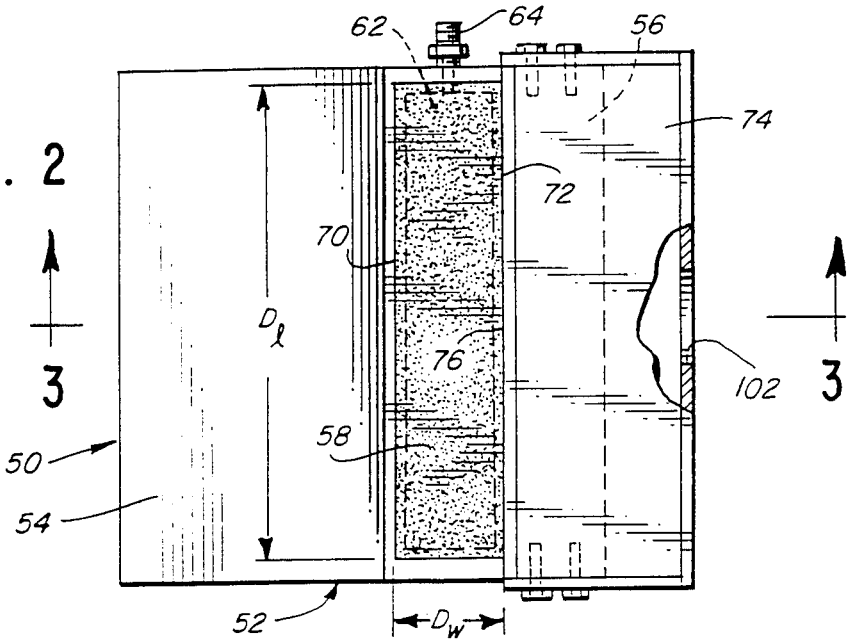
FIG. 2 (on the second sheet of the drawing) is a plan view of another embodiment of the fluid diffuser of this invention.
Figure 3:
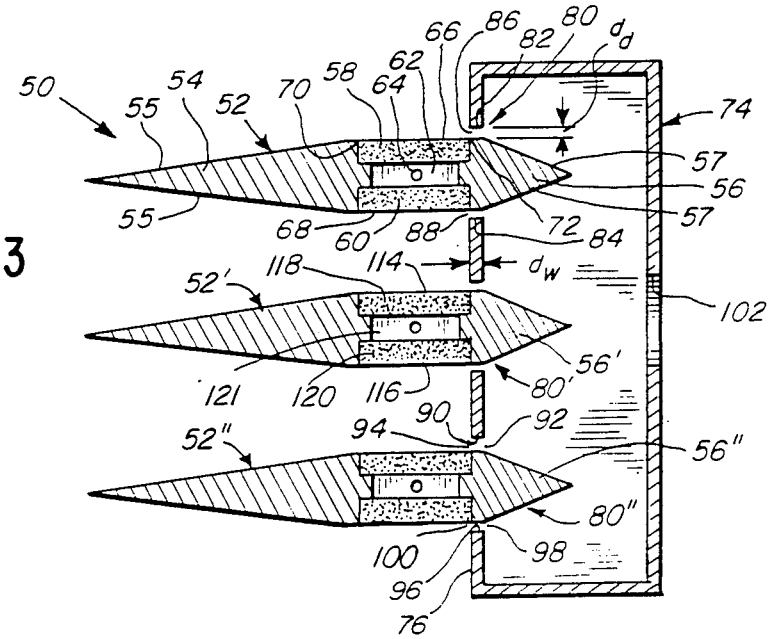
FIG. 3 is a cross-sectional view of the embodiment of FIG. 2, taken along the line 3—3 of the latter Figure.

A second embodiment of the fluid diffuser of this invention is shown in plan view in FIG. 2 and in section in FIG. 3.

As seen in FIG. 3, fluid diffuser 50 includes elongated, fluid-emitting members 52, 52' and 52" for immersion in a body of receiving liquid (not shown). Fluid-emitting member 52 has reduced, tapered portion 54 at its front end and reduced, tapered portion 56 at its rear end. The top wall of reduced portions 54 and 56 is connected by porous wall 58, with the upper surfaces of said wall together forming an over-all surface that is generally convex in shape. The lower walls of front end 54 and rear end 56 are similarly connected by porous wall 60, with the surfaces of these three wall sections also forming an over-all surface that is generally convex in shape.

As seen, the taper in the front and rear reduced portions of fluid-emitting members 52, 52' and 52" is linear, with the top and bottom walls of each of these members being formed of three planar surfaces. To minimize turbulence and help to maintain laminar flow in the streams of shearing liquid, top and bottom planar surfaces 55 of front reduced portion 54 preferably form an angle of something less than 15°. Top and bottom planar surfaces 57 of rear reduced portion 56 are preferably at an angle to each other of less than 30°.

The maximum thickness of fluid-emitting member 52 between foraminous surfaces 66 and 68 should not be too large, in order to keep the length of the taper of front section 54, on the discharge side of member 52, from being too large. The preferred ratio of the maximum thickness of the fluid-emitting member to its overall length from rear to front is 1:9 or smaller.

The convex top and bottom surfaces of the fluid-emitting member may, if desired, be curved in cross section, which will be more difficult to fabricate but will provide improved hydrodynamic performance for the streams of shearing liquid employed with this invention.

Porous walls 58 and 60, together with front end 54 and rear end 56 of elongated fluid-emitting member 50, define fluid plenum 62 and fluid inlet 64 for supplying fluid under pressure to the interior of the plenum. Porous walls 58 and 60 have foraminous outer surfaces 66 and 68, respectively. Walls 58 and 60 permit the passage of fluid from plenum 62 through foraminous surfaces 66 and 68 into the body of liquid in which fluid-emitting member 50 is immersed. Each foraminous surface has a front or downstream border and a rear or upstream border as, for example, front or downstream border 70 and rear or upstream border 72 of surface 66.

The porous material of which walls 58 and 60 are formed may be sintered metal, a porous ceramic, porous plastic, a porous composite material, or any other suitable material having fluid transmitting passages therethrough that terminate in a foraminous surface.

Figure 4:
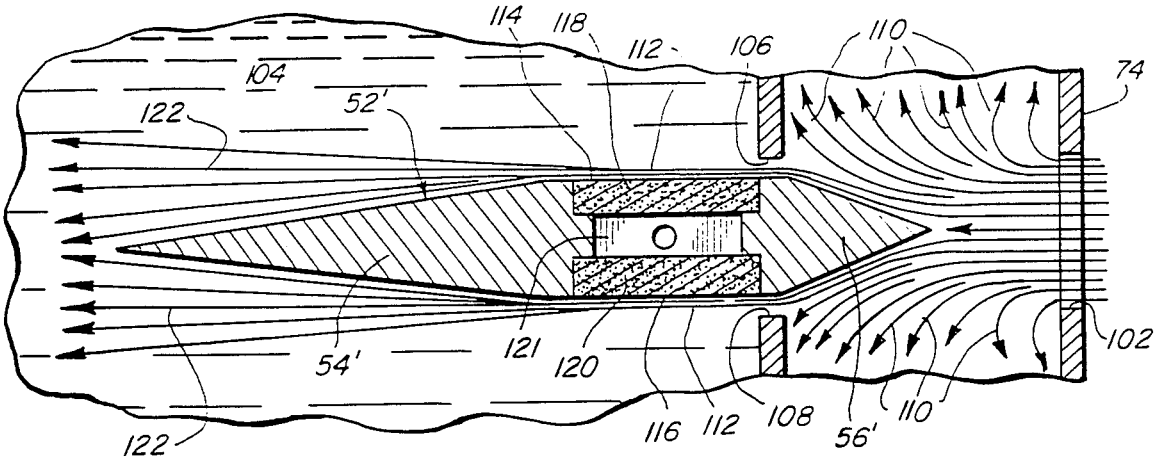
FIG. 4 is an enlarged cross-sectional view of a portion of the fluid diffuser of FIGURES 2 and 3, with an idealized, diagrammatic showing of stream lines representing the flow of shearing liquid in the diffuser device.

The embodiment of FIGS. 2–4 includes slot-forming chamber 74. Front wall 76 of chamber 74 defines elongated openings 80, 80' and 80" to accept reduced rear portions 56, 56' and 56" of fluid emitting members 52, 52' and 52", respectively, when these members are inserted within the corresponding outlet openings. Elongated opening 80 has two internally facing imperforated walls 82 and 84, each of which faces a portion of either the top or bottom wall of the two opposed plenum-defining, imperforate walls, of generally convex configuration, of fluid-emitting member 52. Internally facing walls 82 and 84 are imperforate throughout their entire extent.

The described structure forms narrow, elongated slot 86 above fluid-emitting member 52 and a similar slot 88 below member 52.

In the embodiment of the fluid diffuser of this invention shown in FIGS. 2 and 3, fluid-emitting members 52, 52' and 52" are stacked vertically one above the other, with elongated slots 86 and 88 and the other similar slots of the device oriented in horizontal positions. If desired, the fluid diffuser of this invention may be positioned to orient slots 86, 88 and other similar slots in vertical positions, or even in diagonal positions, as required by the particular application in which the diffuser is employed.

Narrow, elongated slots 86 and 88 extend parallel to foraminous outer surfaces 66 and 68, respectively, of the top and bottom plenum-defining walls, and are located adjacent rear or upstream border 72 at the top, and the similar rear or upstream border at the bottom, of fluid-emitting member 52. In the embodiment discussed, the rear or upstream borders are located immediately adjacent their respective slots 86 and 88, with the entire area of foraminous surfaces 66 and 68 lying outside the slots. As a result, the portions of the opposed plenum-defining walls that help define elongated slots 86 and 88 are imperforate throughout their entire extent.

As will be seen from the drawing, slot 86 has an inlet end (on the right in FIG. 3) in communication with slot-forming chamber 74 and an outlet end (on the left in FIG. 3) in communication with the tank containing the body of receiving liquid. Similarly, slot 90 located at the top of fluid-emitting member 52" has an inlet end 92 and an outlet end 94. Slot 96, located at the bottom of fluid-emitting member 52", has an inlet end 98 and an outlet end or opening 100. The slot above and below fluid-emitting member 52' are of course similarly constructed.

As indicated above, FIG. 2 is a top plan view of the embodiment of the fluid diffuser of this invention of which FIG. 3 gives a cross-sectional view. As will be seen, length $D_l$ of porous wall portion 58 determines the length of slot 86.

The width $D_w$ of porous wall portion 58 is determined by a number of factors, including the size of the foramina in the porous member, the viscosity of the shearing liquid, and the pressure at which shearing liquid is introduced into slot-forming chamber 74 (which determines the velocity at which the shearing liquid exits from slots 86, 88, and the other similar slots in wall 76 of slot-forming chamber 74). Porous wall portions as wide as 1" to 3", or even more, can be used with the diffuser of this invention. This substantial width of the porous action of the diffuser, which makes possible a high gas flow rate, is one of the important advantages of this invention.

FIG. 4 is an enlarged fragmentary view of fluid-emitting member 52' of fluid diffuser 50 shown in FIG. 3, with the body of receiving liquid indicated as 104. This figure also shows various stream lines indicating diagrammatically the flow of shearing liquid through and out of slot-forming chamber 74 through narrow, elongated slots 106 and 108 above and below member 52', and from there to the left into body of receiving liquid 104.

Stream lines 110 illustrate diagrammatically the flow of shearing liquid into slot-forming chamber 74 and from there past fluid-emitting member 52', above and below the latter member. Stream lines 112 illustrate how the shearing liquid flows along and in contact with foraminous surfaces 114 and 116 of porous walls 118 and 120, respectively, which walls define fluid plenum 121. Finally, stream lines 122 illustrate diagrammatically how the flow of shearing liquid, with the fine gas bubbles or fine liquid droplets dispersed therein, continues to the left in FIG. 4 over and beyond front end 54' or fluid-emitting member 52'.

In the embodiment of FIGS. 2–4, fluid-emitting members 52, 52' and 52" should be spaced far enough from each other that streams of shearing liquid associated with each of those members, together with the dispersed fine gas bubbles or liquid droplets contained therein, do not interfere with each other. Such interference must be avoided in order to minimize coalescence of the fine bubbles or droplets after they have been sheared off the respective foraminous surfaces of the external walls of the fluid plenum and swept off to the left in those figures.

With the described construction, fluid introduced under pressure into fluid plenum 62 through fluid inlet 64 will flow out through porous wall portions 58 and 60 to produce nascent fluid spheroids on foraminous surfaces 66 and 68, respectively, of those porous walls. Shearing liquid introduced under pressure through inlet 102 into slot-forming chamber 74 will exit through narrow, elongated slots 86 and 88, as well as through the other similar slots such as slots 90 and 96, to form streams of liquid that then sweep across and in contact with each of the foraminous outer surfaces of the plenum-defining walls of fluid-emitting members 52, 52' and 52", to shear nascent spheroids off those foraminous surfaces. This shearing action forms fine gas bubbles or fine liquid droplets, as the case may be, which are carried into the body of receiving liquid by the streams of shearing liquid exiting from the slot in question, and thus move into the body of receiving liquid.

Third Embodiment Of Apparatus

Figure 6:
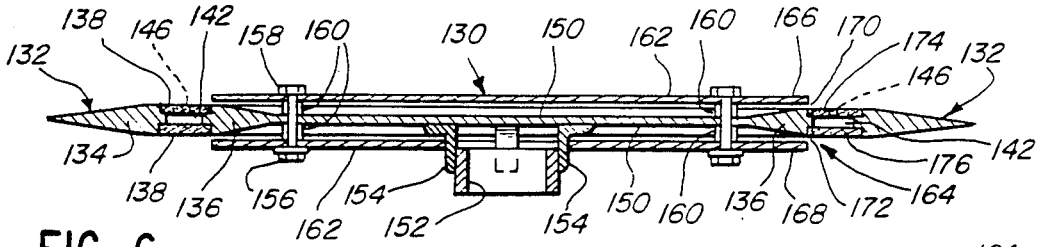
FIG. 6 is a cross-sectional view of the embodiment of FIG. 5, taken along the line 6—6 in the latter Figure.

FIG. 5 is a top plan view of a third embodiment 130 of the fluid diffuser of this invention. FIG. 6 is a cross-sectional view of the same embodiment, taken along the line 6—6 in FIG. 5. This third embodiment discharges sheared gas bubbles or liquid droplets in a circular pattern for 360° around the diffuser. For this reason, this embodiment is preferred for use with circular tanks of receiving liquid.

Fluid diffuser 130 comprises annular fluid-emitting member 132, which includes reduced, tapered portion 134 at its outer perimeter and reduced, tapered portion 136 at its inner perimeter, which parts are the front or downstream or upstream end, respectively, of the various segments of annular member 132 across which shearing liquid flows as explained below. Reduced portions 134 and 136 are connected by porous wall 138 at the top and bottom of the fluid-emitting member, with the result that that member has an elongated cross-sectional shape.

The top wall formed of front reduced portion 134, porous section 138 and rear reduced portion 136 is generally convex in cross-sectional shape, and the same is true of the bottom wall of member 132. The two opposed walls at the top and bottom of fluid-emitting member 132 define fluid plenum 142 (best seen in FIG. 6). As will be seen, fluid-emitting member 132 is generally similar in cross section to fluid-emitting members 52, 52' and 52" of the embodiment of FIGS. 2–4 discussed above.

Four arcuate porous wall portions 138 are embedded in top wall 144 of fluid-emitting member 132. Top wall 144 defines fluid inlets 146 for supplying fluid under pressure from a fluid source (not shown) to fluid plenum 142.

Annular fluid-emitting member 132 is supported by X-frame 150, which in turn is supported by shearing liquid inlet pipe 152 through suitable attaching brackets 154. Nut-and-bolt combinations 156/158, together with cylindrical spacers 160, support circular plates 162 above and below X-frame 150 and annular fluid-emitting member 132.

Plates 162 function as the walls of a slot-forming chamber, defining elongated, annular outlet opening 164 around the perimeter of the chamber. Opening 164 accepts rear or upstream reduced portion 136 of fluid-emitting member 132 when that member is positioned within opening 164. Opening 164 has two internally facing, imperforate walls 166 and 168, each of which faces a portion of the top and bottom walls, respectively, of fluid-emitting member 132. Between them, walls 166 and 168 on the one hand, and imperforate, rear or upstream reduced portion 136 of member 132 on the other, define narrow, elongated, annular slots 170 and 172, respectively.

Slots 170 and 172 extend parallel to annular, foraminous outer surfaces 174 and 176 on top and bottom porous walls 138 that define fluid plenum 142, and their outlet ends or openings are located immediately adjacent the inner perimeters of foraminous surfaces 174 and 176.

When fluid is supplied under pressure to plenum 142, it will flow out through porous walls 138 to produce small nascent fluid spheroids on top and bottom foraminous surfaces 174 and 176, respectively, of those porous walls. Shearing liquid introduced into slot-forming chamber 130 under pressure will exit through each of the narrow, elongated, annular slots 170 and 172 to form streams of liquid that then sweep across and in contact with outer surfaces 174 and 176, respectively, of walls 138 of fluid-emitting member 132. These streams of liquid shear nascent fluid spheroids off foraminous surfaces 174 and 176 to form fine gas bubbles or fine liquid droplets, which are then carried into the body of receiving liquid by the streams of shearing liquid as they move on into the receiving liquid.

This embodiment illustrated in FIGS. 5 and 6 is intended to be used with fluid-emitting member 132 and its supporting structure held in a stationary position by fluid inlet pipe 152. If desired, through appropriate modification of its supporting structure, fluid diffuser 130 can be rotated within the body of receiving liquid. This would require, among other things, an inlet passage extending from the center of the apparatus outward to fluid plenum 142, so that the fluid to be dispersed in the body of receiving liquid could be continuously supplied to the plenum.

Fourth Embodiment Of Apparatus

Figure 7:
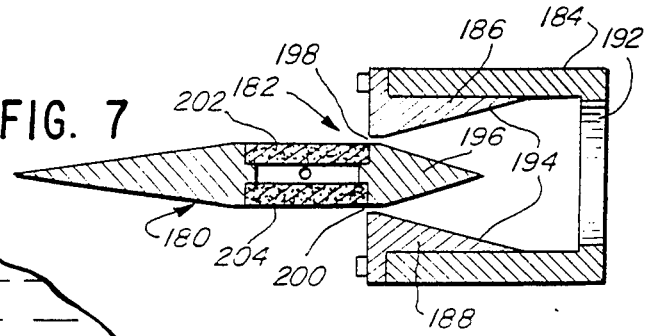
FIG. 7 is a cross-sectional view of still another embodiment of the fluid diffuser of this invention.

FIG. 7 shows an embodiment of the fluid diffuser of this invention in which fluid-emitting member 180 is inserted in elongated outlet opening 182 on one side of slot-forming chamber 184. In this embodiment, the interior of slot-forming chamber 184 is defined by slanting upper wall 186 and slanting lower wall 188.

Both walls taper gradually inward from the vicinity of inlet opening 192 at the rear of slot-forming chamber 184. Slanting walls 186 and 188 together effectively form nozzle 194 that directs shearing liquid into and through narrow, elongated slots 198 and 200 formed between outlet opening 182 and the top and bottom walls, respectively, of fluid-emitting member 180.

The effect of nozzle 194 is to produce a more effective stream of shearing liquid across and in contact with foraminous surfaces 202 and 204 of the top and bottom porous walls, respectively, of member 180.

Method Of The Invention

The method of this invention employs the apparatus of the invention that has been thus far described.

As already mentioned above, in some applications it will be desirable for the shearing liquid to be the same as the receiving liquid, and in other applications the shearing liquid may be different from the receiving liquid. As also indicated, the fluid to be dispersed in the receiving liquid may be any suitable gas or liquid.

The type of flow produced in the streams shearing liquid employed with this invention is influenced by several things:

1. The viscosity of the fluid that is introduced into the body of receiving liquid;
2. The viscosity of the receiving liquid;
3. The viscosity of the shearing liquid (which may or may not be the same liquid as the receiving liquid);
4. The flow rate of the receiving liquid;
5. The velocity of the shearing liquid; and
6. The size of the foramina in the porous walls of the fluid plenum.

In the method of this invention, a fluid diffuser such as one of the four embodiments discussed above is employed. The size, shape and dimensions of the narrow, elongated slot or slots through which a stream or streams of shearing liquid flow are selected to establish, under given conditions of use, boundary layer flow in the liquid that exits from the slot-forming chamber through the slot or slots in question and then moves across and in contact with the foraminous outer surface of the one or more plenum-defining porous walls of the fluid-emitting member.

Improved results are obtained if the size, shape and dimensions of the narrow, elongated slot or slots through which the shearing liquid exits are selected to establish, under given conditions of use, partially developed substantially parallel laminar boundary layer flow in the liquid exiting from the slot or slots and moving across and in contact with the foraminous outer surfaces on which nascent spheroids of the fluid to be dispersed in the receiving liquid are formed. Preferably this laminar boundary layer flow is substantially parallel to and immediately adjacent the foraminous outer surface or surfaces referred to.

Further improvement is produced in the method of this invention if the size, shape and dimensions of the narrow, elongated slot or slots through which shearing liquid flows are selected so that the partially developed substantially parallel laminar boundary layer flow referred to extends over a substantial portion of the foraminous outer surface or surfaces of said at least one plenum-defining wall of the fluid-emitting member, and preferably over substantially all of the foraminous surface or surfaces.

Still further improvement is obtained in the method of this invention when the slot size, shape and dimensions are selected so that the substantially parallel laminar boundary layer flow just described is fully developed.

The adjustments in the parameters of the method of this invention that can be made by one skilled in the art to achieve the flow regimes just described include several things. Thus, for a given receiving liquid, a given shearing liquid, and a given gas to be dispersed in the receiving liquid, wider slot widths are used for increased gas flow rates. As another example, shear rates are increased to maintain high levels of gas dissolution with higher gas flow rates. But the shear rate is not increased too much, or the boundary layer flow will become turbulent and defeat the goal of maintaining the indicated flow regimes in the streams of shearing liquid. As another example, the higher the viscosity of the fluid being introduced into the receiving liquid, the larger the foramina should be in the porous walls of the fluid plenum.

The above detailed description of this invention has been given for clarity of understanding only. No unnecessary limitations should be understood therefrom, as modifications will be obvious to those skilled in the art.

We claim:

1. A fluid diffuser for dispersing gas bubbles or liquid droplets into a body of receiving liquid, said fluid being supplied under pressure to the diffuser from a fluid source, said diffuser being activated by a shearing liquid supplied under pressure to the diffuser from a shearing liquid source, which fluid diffuser comprises:

(a) a fluid-emitting member for communication with said body of receiving liquid, said member including external walls that define a fluid plenum and define a fluid inlet for supplying fluid under pressure to the interior of said fluid plenum, a portion of at least one of said walls being porous and having a foraminous outer surface, said porous wall portion permitting the passage of fluid from said plenum through said foraminous outer surface and into said body of liquid, said foraminous surface having a downstream border and an upstream border; and (b) a slot-forming chamber having a wall that defines a narrow, elongated slot extending parallel to said foraminous outer surface of said at least one plenum-defining wall of said fluid-emitting member, said slot being formed by two opposed interior walls each of which is imperforate for substantially its entire extent, said slot having an inlet end and an outlet opening and providing a narrow passage to direct the flow of a stream of said shearing liquid therethrough and across and in contact with the foraminous outer surface of said fluid-emitting member, the downstream extension of each straight line that lies in a predetermined one of said opposed interior walls just upstream of said outlet opening, and that is oriented in the direction of flow of said stream of shearing liquid, lying in said foraminous surface in at least the portion of said surface adjacent said outlet opening, the cross-sectional area of the path open to the flow of said stream of shearing liquid as it moves in a downstream direction from said outlet opening of said elongated slot and across said foraminous surface being larger at all points than the cross-sectional area of said outlet opening and not decreasing at any point downstream of said outlet opening, the outlet opening of said slot being located adjacent said upstream border of said foraminous outer surface, with said foraminous outer surface lying primarily outside and primarily downstream of said slot, the inlet end of said slot being in communication with said chamber and its outlet opening in communication with said body of receiving liquid, said chamber having an inlet for the introduction into the chamber of said shearing liquid under pressure, whereby said fluid supplied under pressure to said plenum will flow out through said porous wall portion to produce small nascent fluid spheroids on said foraminous surface, and shearing liquid introduced into said slot-forming chamber under pressure will exit through the outlet opening of said narrow, elongated slot to form a stream of liquid that then sweeps across and in contact with at least a majority of the area of said foraminous outer surface of said plenum-defining wall of said fluid-emitting member, to shear said nascent spheroids off said foraminous surface and form fine gas bubbles or fine liquid droplets, which are carried into said body of receiving liquid by said stream of shearing liquid as it exits from said slot and moves into the body of receiving liquid.

2. The fluid diffuser of claim 1 in which the outlet opening of said narrow, elongated slot is located immediately adjacent said upstream border of said foraminous outer surface of said plenum-defining wall of said fluid-emitting member.

3. The fluid diffuser of claim 1 in which the surfaces of both said opposed interior walls of the narrow, elongated slot are planar and are substantially parallel to each other throughout the extent of said slot.

4. The fluid diffuser of claim 3 in which said foraminous outer surface of said plenum-defining wall of said fluid-emitting member is a substantially planar surface, and the surface of one of said interior opposed walls of said narrow, elongated slot lies in substantially the same plane as said foraminous outer surface, and the path followed by said stream of shearing liquid as it sweeps across said foraminous surface lies adjacent and in contact with said porous wall portion.

5. The fluid diffuser of claim 1 in which each of said opposed interior walls forming said narrow, elongated slot is imperforate throughout its extent.

6. A fluid diffuser for dispersing gas bubbles or liquid droplets into a body of receiving liquid, said fluid being supplied under pressure from a fluid source, said diffuser being activated by a shearing liquid supplied under pressure to the diffuser from a shearing liquid source, which fluid diffuser comprises:

(a) an elongated fluid-emitting member for immersion in said body of receiving liquid, said member having a reduced portion at both its downstream and upstream ends and comprising two opposed walls each of which is generally convex in shape, said two walls defining a fluid plenum and defining a fluid inlet for supplying fluid under pressure to the interior of said fluid plenum, at least a portion of each of said two opposing walls of said fluid-emitting member being porous, each of said porous wall portions having a foraminous outer surface and permitting the passage of fluid from said plenum through said foraminous surface into said body of liquid, said foraminous surface having a downstream border and an upstream border; and (b) a slot-forming chamber having a wall that defines an elongated opening on one side of the chamber to accept said upstream reduced portion of said fluid-emitting member when said member is inserted within said outlet opening, said elongated opening having two internally facing walls each of which is imperforate for substantially its entire extent, each of said walls facing a portion of one of said two opposed plenum-defining walls of said fluid-emitting member to form a narrow, elongated slot extending parallel to said foraminous outer surface of said plenum defining wall, said portions of said two plenum-defining walls being imperforate for substantially their entire extent, said slot having an inlet end and an outlet opening and providing a narrow passage to direct the flow of a stream of said shearing liquid therethrough and across and in contact with said foraminous outer surface of said fluid-emitting member, the downstream extension of each straight line that lies in said portion of said plenum-defining wall just upstream of said outlet opening, and that is oriented in the direction of flow of said stream of shearing liquid, lying in said foraminous surface in at least the portion of said surface adjacent said outlet opening, the cross-sectional area of the path open to the flow of said stream of shearing liquid as it moves in the downstream direction from said outlet opening and across said foraminous surface being larger at all points than the cross-sectional area of said outlet opening and not decreasing at any point downstream of said outlet opening, the outlet opening of said slot being located adjacent said upstream border of said foraminous outer surface, the inlet end of each slot being in communication with said chamber and the outlet opening in communication with said body of receiving liquid, said foraminous outer surface of said plenum-defining wall lying primarily outside and primarily downstream of said slot, said chamber having an inlet for the introduction into the chamber of said shearing liquid under pressure, whereby said fluid supplied under pressure to said plenum will flow out through each of said porous wall portions to produce small nascent fluid spheroids on said foraminous surface, and shearing liquid introduced into said slot-forming chamber under pressure will exit through the outlet opening of each of said narrow, elongated slots to form a stream of liquid that then sweeps across and in contact with a majroity of the area of each of said foraminous outer surfaces of said plenum-defining walls of said fluid-emitting member, to shear said nascent spheroid off said formaminous surface and form fine gas bubbles or fine liquid droplets, which are carried into said body of receiving liquid by said stream of shearing liquid as it exits from said slot and moves into the body of receiving liquid.

7. The fluid diffuser of claim 6 in which the outlet opening of each of said narrow, elongated slots is located immediately adjacent said upstream border of said foraminous outer surface of the respective one of said plenum-defining walls of said fluid-emitting member.

8. The fluid diffuser of claim 7 in which each of said internally facing walls of said outlet opening in said slot-forming chamber and the one of said walls of said fluid-emitting member with which it forms one of said narrow, elongated slots are substantially parallel to each other throughout the extent of said slot.

9. The fluid diffuser of claim 8 in which each of said foraminous outer surfaces of said two opposed walls of said fluid-emitting member is a substantially planar surface and the surface of said slot-forming wall of said fluid-emitting member that lies adjacent thereto is substantially coplanar therewith.

10. The fluid diffuser of claim 6 in which each of said two internally facing walls of said elongated opening and each of said portions of said two opposed plenum-defining walls of said fluid-emitting member, which together form two narrow, elongated slots, is imperforate throughout its extent.

* * * * *